US006899184B2

(12) United States Patent
Reynolds

(10) Patent No.: US 6,899,184 B2
(45) Date of Patent: May 31, 2005

(54) FIRE SUPPRESSION SYSTEM AND METHOD FOR AN INTERIOR AREA OF AN AIRCRAFT LAVATORY WASTE CONTAINER FIRE PROTECTION

(75) Inventor: Thomas L. Reynolds, Bainbridge Island, WA (US)

(73) Assignee: The Boeing Company, Chicago, IL (US)

( * ) Notice: Subject to any disclaimer, the term of this patent is extended or adjusted under 35 U.S.C. 154(b) by 244 days.

(21) Appl. No.: 09/918,221

(22) Filed: Jul. 30, 2001

(65) Prior Publication Data

US 2003/0019641 A1 Jan. 30, 2003

(51) Int. Cl.[7] ..... A62C 3/07

(52) U.S. Cl. ..... 169/62; 169/9; 169/16; 169/60; 169/61; 244/129.2

(58) Field of Search ..... 169/9, 16, 37, 169/57, 60, 61, 62, 70, 23; 244/118.5, 129.2; 340/577, 584, 590, 593

(56) References Cited

U.S. PATENT DOCUMENTS

| | | | | | |
|---|---|---|---|---|---|
| 2,560,091 | A | * | 7/1951 | Davis | 169/62 |
| 3,135,330 | A | * | 6/1964 | Hanson et al. | 169/60 |
| 3,387,662 | A | | 6/1968 | Molgano, Jr. | |
| 3,756,320 | A | * | 9/1973 | McMahon | 169/61 |
| 3,865,192 | A | | 2/1975 | Dunphy | |
| 3,866,687 | A | * | 2/1975 | Banner | 169/61 |
| 4,248,309 | A | | 2/1981 | Hofle et al. | |
| 4,347,901 | A | * | 9/1982 | Wilhoit | 169/62 |
| 4,351,394 | A | * | 9/1982 | Enk | 169/61 |
| 4,625,808 | A | | 12/1986 | Halfpenny | |
| 4,646,848 | A | | 3/1987 | Bruensicke | |
| 4,984,637 | A | * | 1/1991 | Finnigan | 169/61 |
| 5,038,867 | A | | 8/1991 | Hindrichs et al. | |
| 5,040,611 | A | | 8/1991 | Steel | |
| 5,052,493 | A | | 10/1991 | Court | |
| 5,402,967 | A | | 4/1995 | Hughes | |
| 5,425,886 | A | | 6/1995 | Smith | |
| 5,515,691 | A | | 5/1996 | Wertenbach et al. | |
| 5,720,351 | A | * | 2/1998 | Beukema et al. | 169/61 |
| 5,908,074 | A | * | 6/1999 | Potts | 169/60 |
| 6,007,025 | A | | 12/1999 | Coughren et al. | |
| 6,029,751 | A | | 2/2000 | Ford et al. | |

FOREIGN PATENT DOCUMENTS

| | | |
|---|---|---|
| GB | 2 275 871 A | 9/1994 |
| WO | WO 91/07208 | 5/1991 |

OTHER PUBLICATIONS

European Search Report dated Nov. 24, 2003; Examiner van Bilderbeek, H.; in re Application Number EP 02 07 7232; 2 pages.

* cited by examiner

*Primary Examiner*—Steven J. Ganey
(74) *Attorney, Agent, or Firm*—Harness, Dickey & Pierce, PLC

(57) ABSTRACT

A fire suppression system adapted for use in a lavatory of an aircraft. The system includes a water supply coupled to one or more fluid discharge nozzles via one or more fluid flow lines. A pressure source in communication with the fluid flow lines provides pressure to assist in supplying a pressurized flow of fluid through the flow line(s) to the nozzles (s). The fire suppression system creates a spray of water capable of suppressing fires within a waste container area or within the entire lavatory area. Heat sensitive valves enable the system to automatically detect the start of a fire. Furthermore, the system is capable of using the potable water supply of the aircraft or it can be self-contained with its own water supply reservoir. If self-contained, the system includes a pressurized fluid source to assist in supplying water to the discharge nozzle(s).

13 Claims, 3 Drawing Sheets

FIRE SUPPRESSION SYSTEM AND METHOD FOR AN INTERIOR AREA OF AN AIRCRAFT LAVATORY WASTE CONTAINER FIRE PROTECTION

FIELD OF THE INVENTION

The present invention relates to fire suppression systems. More particularly, the present invention relates to water based fire suppression systems on aircraft.

BACKGROUND OF THE INVENTION

It is generally known to include a fire suppression system in certain portions of aircraft, in particular lavatories and the waste containers within the lavatories. One fire suppression system includes a canister filled with pressurized Halon. Such Halon systems, however, are no longer desirable for fire suppression. Also, any chemical fire suppressant which is pressurized within a canister includes these similar disadvantages.

One disadvantage of the pressurized chemical systems is that the only way to determine when such a system has been discharged or is leaking is to dismantle it and weigh the bottle holding the pressurized chemical to determine if the amount present is within acceptable ranges. This requires that the system is substantially dismantled and parts of it are removed from the aircraft itself. Thus, a large amount of labor and time is required to ensure that such systems remain within acceptable operating ranges.

Another disadvantage is when the pressurized chemical fire suppression system has been discharged, the bottle holding the pressurized chemical must be replaced. These systems do not allow easy recharging of the pressurized chemical to reuse the system since they must be sent to the manufacturer for recharge. Furthermore, other portions of the system, including the nozzles and lines, may also need to be replaced after only one discharge of the fire suppression system.

Yet a further disadvantage of the pressurized chemical systems includes the chemical itself. It has become undesirable to emit such chemicals into the atmosphere and some have been banned due to ozone depletion. Therefore, it has become desirable to use a fire suppression system that does not employ a pressurized chemical such as Halon.

It would therefore be highly desirable to provide a fire suppression system that operates without introducing undesirable chemicals into the environment.

It would also be desirable to provide a fire suppression system which enables easy identification of whether the fire suppression system has been activated. Furthermore, it would be helpful if the system allowed a maintenance person to easily identify whether the system must be recharged or serviced.

It would be a further advantage to provide a fire suppression system which could be installed on an aircraft without requiring significant structural modifications to the aircraft Still further, it would be desirable to provide a fire suppression system for any aircraft lavatory or waste container used in the lavatory, which does not require extensive machining and creation of new parts for the fire suppression system.

It is also desirable to provide a system that may be easily installed in the aircraft, and which forms a small modular apparatus that may be used with its own water supply or with the main water supply of the aircraft.

SUMMARY OF THE INVENTION

The present invention includes a fire suppression system especially well suited for waste containers used in lavatories and other limited access spaces of commercial and private aircraft. The present invention may also be readily adapted for fire suppression of the entire lavatory or fire suppression of the entire aircraft including cargo areas. In a preferred embodiment, the present invention includes one or more spray nozzles that respond to heat, thereby releasing water from a reservoir or from the aircraft's water system. In a second alternative embodiment, the present invention includes sensors that sense heat, flame, or smoke, and which activate the system releasing water from a reservoir or the plane's water system through one or more spray nozzles. In a third alternative embodiment, the present invention forms a self-contained system wherein either sensors or heat or flame detecting nozzles release water from a pressurized canister.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
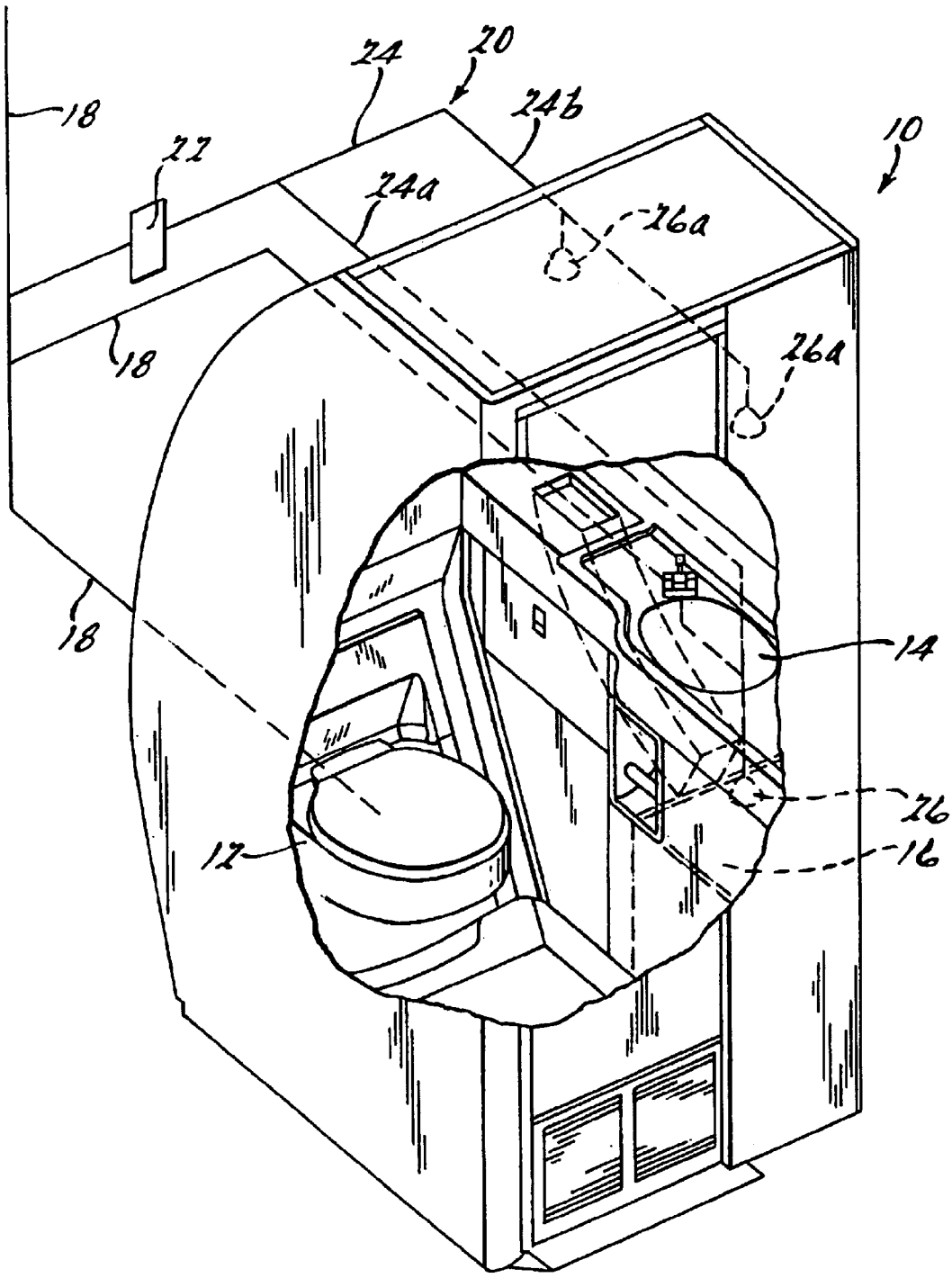
FIG. 1 is an environmental view of a first preferred embodiment of the present invention installed in a lavatory of an aircraft.

With reference to FIG. 1, modern day commercial and private aircraft typically include a lavatory 10. The lavatory 10 generally includes at least a toilet 12, a sink 14, and a waste container 16. Water is generally supplied to the lavatory 10 through one or more water lines 18 that supply water to the toilet 12 and the sink 14. In accordance with a preferred embodiment of the present invention, a fire suppression system 20 is disclosed which makes use of a portion of the water flow diverted from the water lines 18 to suppress fires in the waste container 16 or within the area of the entire lavatory 10.

The system 20 includes a main valve 22 that controls the water supply to one or more fire suppression lines or conduits 24 of the fire suppression system 20. In particular, at least one nozzle 26 in flow communication with the conduits 24 is installed above the waste container 16 to direct water into the waste container 16. The nozzle 26 can be of several types including those that are automatic or actuated by external mechanisms. Pressurized water in the conduit 24*a* is released through the nozzle 26 when the fire suppression system 20 is activated. In this way, fires which might occur in the waste container 16 are suppressed by the release of water. Additional nozzles 26*a* coupled to conduit 24*b* may be placed throughout the lavatory area 10 itself to suppress any fires that may occur within the lavatory 10, as a whole, as opposed to being localized to the waste container 16.

Figure 2:
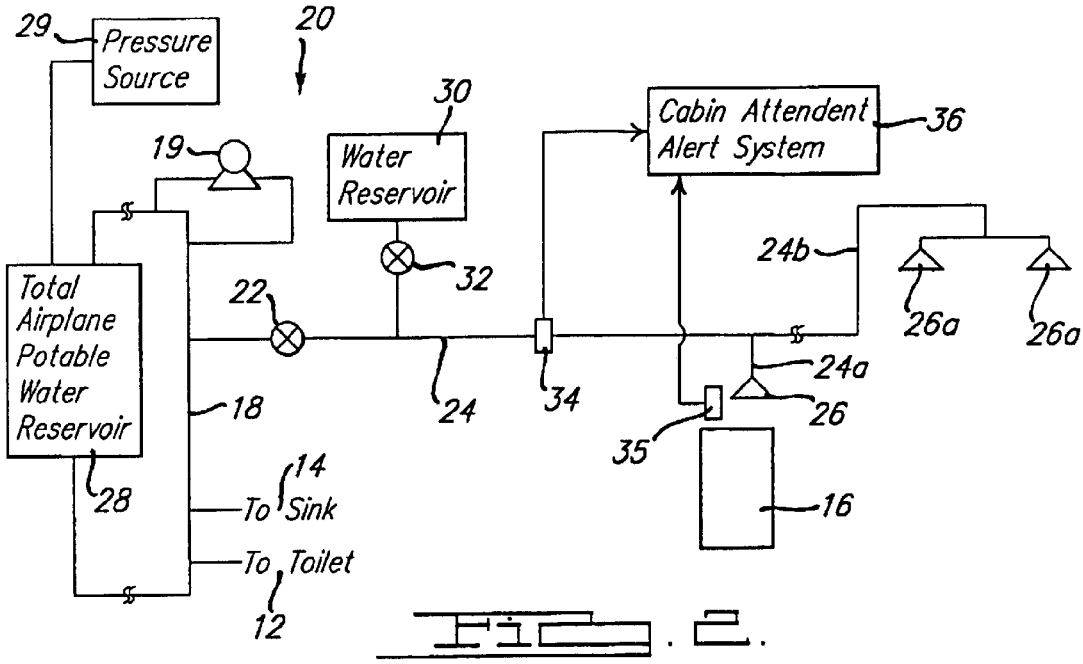
FIG. 2 is a schematic diagram of the first preferred embodiment of the present invention including eutectic valves.

With reference to FIG. 2, a schematic representation of the system 20 is shown. The fire suppression system 20 is tied into the total airplane potable water reservoir 28. The main valve 22 that controls the supply of water to the water suppression system 20 is used to turn off the system 20. A pressure source 29 is connected to the total airplane potable water reservoir 28 to ensure pressure within the total airplane potable water supply 28 and to the water lines 18. The pressure source 29 is preferably a powered compressor or an air-bleed form the aircraft's engines. As an alternative, a pump 19 may be installed in circuit with the water lines 18 to provide down stream pressure to the water in the water lines 18 while not requiring the pressure source 29. An optional water reservoir 30 provides additional water for immediate release onto a fire before depleting the airplane potable water reservoir 28 through the fire suppression system 20. Though the water reservoir 30 is optional, when present it is the primary water supply for the system 20. That is, when the water reservoir is present 30, water is first drained from the water reservoir 30 and only secondarily drained from the total airplane potable water reservoir 28 after the reservoir 30 becomes empty. A second valve 32 provides control of water from the water reservoir 30. The fire suppression water line 24 connects the water reservoir 30 and the water lines 18 of the aircraft to the spray nozzles 26. Fire suppression is optionally provided to the entire lavatory area 10 by adding the additional fire suppression water lines 24*b* and additional fire suppression nozzles 26*a*.

The fire suppression nozzles 26, in one preferred form, include a eutectic valve which will activate the fire suppression system 20 when a fire is present. Eutectic valves melt at a particular temperature thereby opening the valve through the nozzle 26. The eutectic valve is formed, as is well known in the art, by placing a substance which melts over at least a portion of an opening of the nozzle 26. The eutectic substance melts at a temperature low enough so that the fire suppression system 20 is actuated before any fire within the waste container 16, or in the lavatory overall 10, can spread. Once the euteutic valves of the nozzle 26 melt, water can flow through the fire suppression water line 24 out through the nozzle 26. In this way, no additional or active sensors or valves are necessary to release water from the fire suppression system 20 through the nozzles 26.

During operation of the system 20, water is first evacuated from the water reservoir 30, with additional water coming from the total airplane potable water reservoir 28, if needed, until the fire is extinguished. In this embodiment, the system 20 supplies water until shut off by a cabin attendant. A pressure sensor 34 is placed in the fire suppression water line 24 or a heat or smoke detector 35 is provided to send a signal to a cabin attendant alert system 36 to apprise the cabin attendants that the fire suppression system 10 has been evacuated or is activated. In this way, a cabin attendant may go to the lavatory 10 and turn off the fire suppression system 20 or otherwise evaluate the need for further assistance or fire suppression.

The nozzles 26*a* of the lavatory area would also be activated in the event of a fire. Again, the sensor 34 in the fire suppression water line 24 sends a signal to the cabin attendant alert system 36 thereby alerting the cabin attendant that the fire suppression system 20 has been activated.

Figure 3:
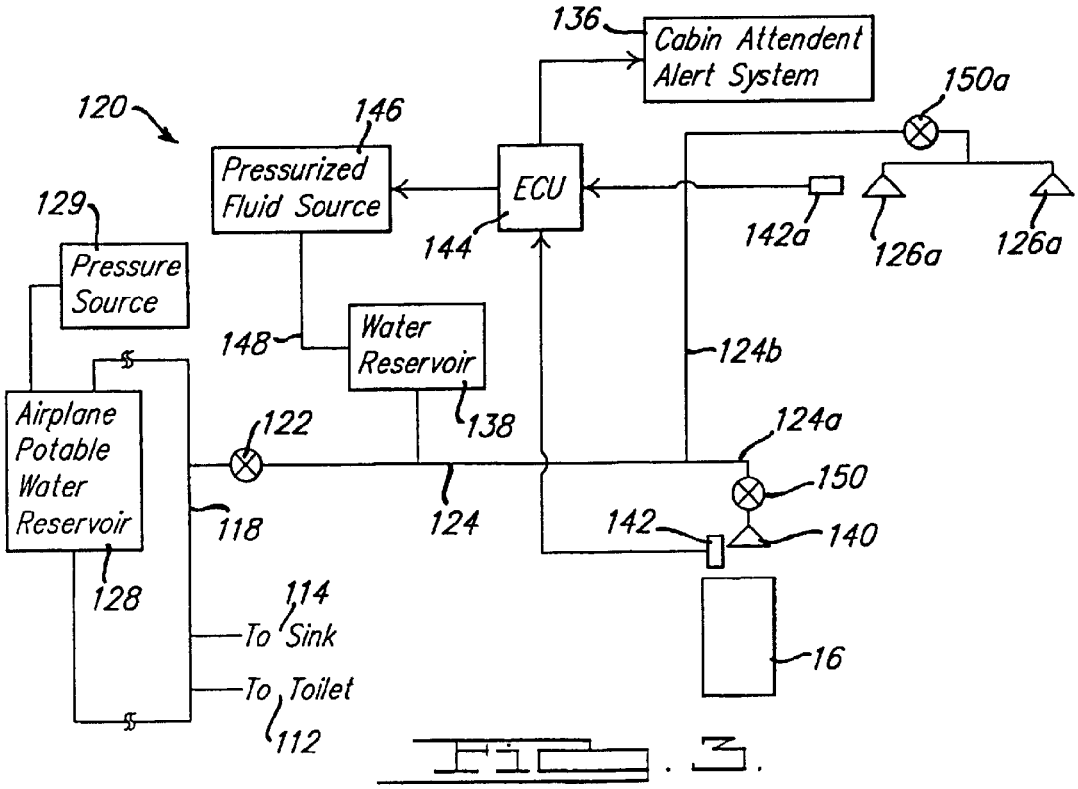
FIG. 3 is a schematic diagram of a second alternative preferred embodiment of the present invention including sensors.

With reference to FIG. 3, a second alternative preferred embodiment 120 of a fire suppression system according to the present invention is illustrated. Like elements corresponding to those of FIG. 2 have been given like numerals increased by 100. In the fire suppression system 120, a primary water reservoir 138 provides a primary source of water to the fire suppression system 120 which is fed through water line 124 when the fire suppression system 120 is activated. A primary valve 122 allows for manual shut-off of the fire suppression system 120 by an individual to stop the fire suppression system 120 or for maintenance. A first nozzle 140 is placed adjacent or above the waste container 16. Additionally, a first sensor 142 is placed above or adjacent the waste container 16. The sensor 142 is able to sense heat or smoke which comes from the waste container 16 when a fire occurs in the waste container. An electronic control unit 144 is connected to the sensor 142 to receive a signal from the sensor 142. A pressurized fluid source 146 is connected to a primary water reservoir 138 through a pressurized fluid source line 148. The pressurized fluid source 146 comprises any suitable device having a compressible fluid to provide a rapid increase of pressure to the primary water reservoir 138 or to the fire suppression water line 124 to provide pressure to fluid traveling through the fire suppression system 120. In one preferred embodiment, the pressurized fluid source 146 comprises a canister pressurized with liquid carbon dioxide. When opened, the carbon dioxide from the pressurized fluid source 146 quickly expands to a gas, thereby pressurizing the suppression system 120.

When the sensor 142 senses heat or smoke that is produced by a fire, a signal is sent to the electronic control unit (ECU) 144. Once the ECU 144 receives the signal, it then sends a signal to the pressurized fluid source 146 that activates the pressurized fluid source 146. When the pressurized fluid source 146 is activated, pressure is transmitted to the water reservoir 138 through the pressurized fluid source line 148. Once the water reservoir 138 is pressurized, water is evacuated through the water line 124 and out the nozzle 140. Before the water from the reservoir 138 is evacuated, the fire suppression water lines 124*a* are dry. Alternatively, a check valve 150 may be installed in the water lines 124*a* which is held closed until water pressurized by the pressurized fluid source 146 is applied. Once the primary water reservoir 138 is emptied, if additional water is needed, water from a potable water reservoir 128 runs through a valve 122, which is normally open, through the airplane water lines 118 and through the fire suppression water line 124. Pressure is provided to the airplane water lines 118 through the pressure source 129. Furthermore, when the electronic control unit 144 receives a signal from the sensor 142, it also in turn sends a signal to the cabin attendant system 136 to apprise a cabin attendant that the fire suppression system 120 has been activated.

In addition, water may be applied to the entire lavatory area 10 through additional nozzles 126*a* which receives water from a water line 124*a* in communication with water line 124, and an additional sensor 142*a* installed to sense a fire that may occur within the lavatory area as a whole. The additional sensor 142*a* acts in a similar way as the sensor 142 to send a signal to the electronic control unit 144 to activate the pressurized fluid source 146. Also, the fire suppression water lines 124*b* are dry before the pressurized fluid source 146 is activated or a check valve 150*a* holds the lines 124*b* closed until the water is pressurized by the pressurized fluid source 146. Additionally, the electronic control unit 144 sends a signal to the cabin attendant system 136 to apprise a cabin attendant that the fire suppression system 120 has been activated. Water which is released from the primary water reservoir 138, travels through the nozzle 140 to extinguish any fire that has occurred in the waste container 16. The nozzles 140 include a valve which is pressure sensitive and which opens when pressurized. Water from the airplane potable water reservoir 128 continues to run through the fire suppression water line 124 and feed the nozzles 140 until the system 120 is turned off by the cabin attendant.

Figure 4:
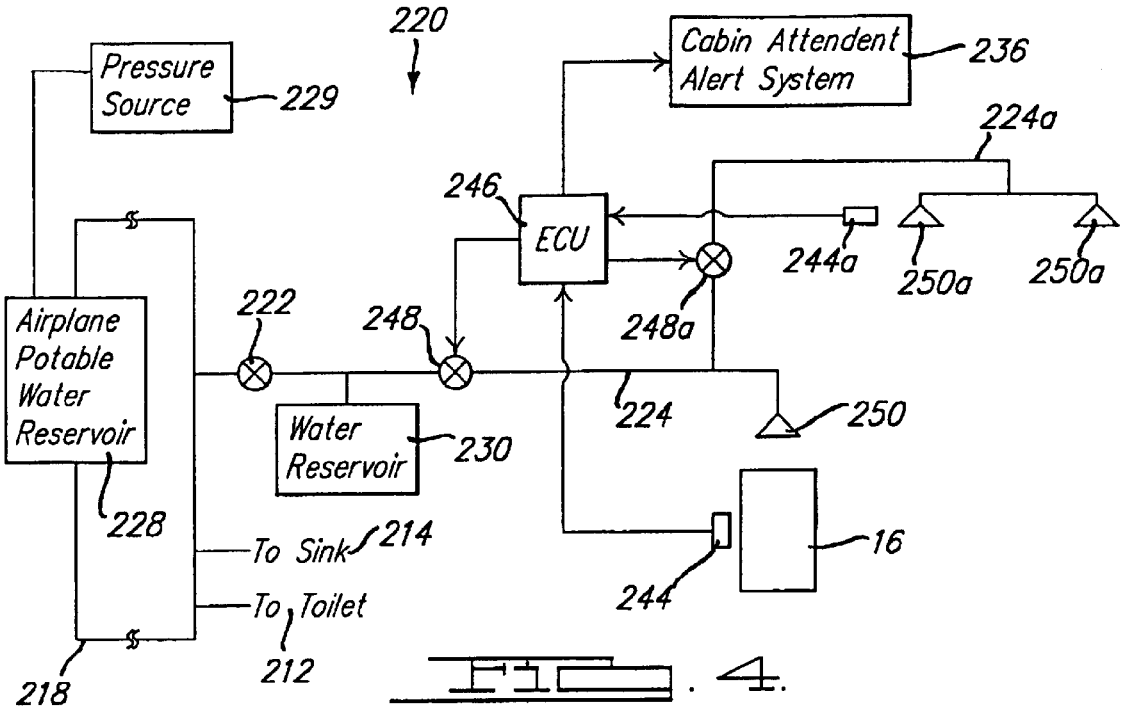
FIG. 4 is a schematic diagram of a third alternative preferred embodiment of the present invention including sensors and electronically controlled solenoid valves.

With reference to FIG. 4, a third alternative preferred embodiment 220 of a fire suppression system according to the present invention is illustrated. Again, elements in common with those of the embodiment of FIGS. 1 and 2 are given like numerals increased by 200. Water for the fire suppression system 220 is provided from an airplane potable water reservoir 228 through airplane water lines 218 and from a water reservoir 230. Pressure is provided to water used by the fire suppression system 220 through an external pressure source 229. Sensor 244, which is sensitive to either smoke or heat, or both, is placed near the waste container 16. An electronic control unit 246 receives signals from the sensor 244. Solenoid valves 248 are placed in the conduit water lines 224 which are opened and closed by the electronic control unit 246. The electronic control unit 246 is also able to send a signal to a cabin attendant alert system 236. Water flows from the reservoir 230 through the conduit water lines 224 and through a nozzle 250 which allows water to be applied to the waste container 16.

The sensor 244 sends a signal to the electronic control unit 246 to indicate that a fire is occurring within the waste container 16. Upon receiving this signal, the electronic control unit 246 sends a signal to a solenoid valve 248 to open the valve 248 to allow water to flow through the fire suppression water line 224 to the nozzle 250. Furthermore, the electronic control unit 246 preferably sends a signal to a cabin attendant alert system 236 to indicate that the system 220 has been activated. The electronic control unit 246 may be programmed to allow water to flow through the system 220 continuously until shut off by an attendant. Alternatively, the electronic control unit 246 may be programmed to shut off the solenoid valve 248 when the sensor 244 no longer senses heat or smoke. Again, additional nozzles 250*a* allow water from the fire suppression system 220 to be introduced into the entire lavatory area 10 via a water line 244*a* in communication with water line 224. A sensor 244*a* sends a signal to the electronic control unit 246 that heat or smoke has been detected from the lavatory area 10. The electronic control unit 246 then opens the solenoid valve 248*a* to allow water to be supplied through the additional fire suppression water lines 224*a* to the nozzles 250*a*. Again, a signal is sent to the cabin attendant alert system 236 to ensure that the cabin attendants know that the fire suppression system 220 has been activated and to alert them that further attention may be needed.

Figure 5:
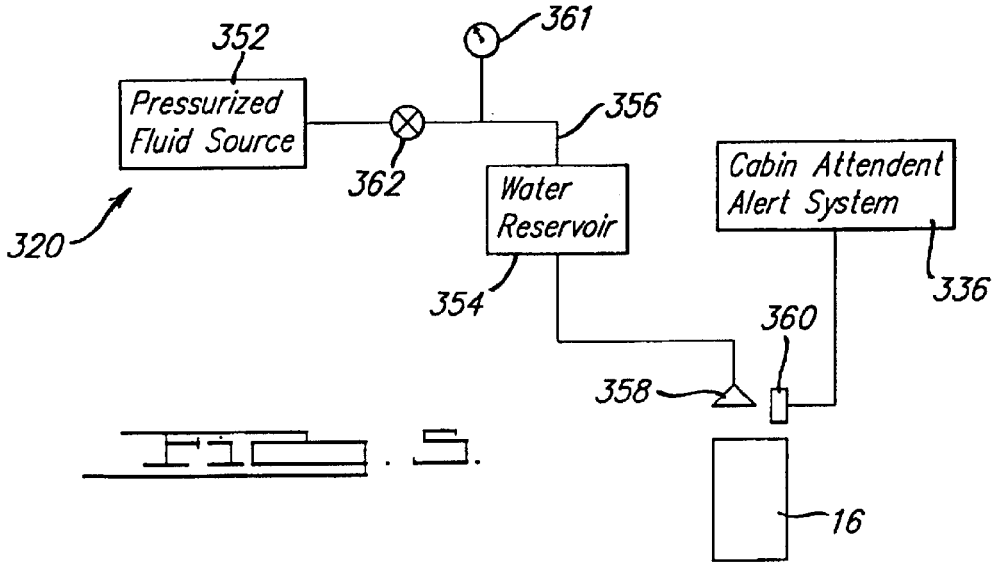
FIG. 5 is a schematic diagram of a fourth alternative preferred embodiment of the present invention including a modular system.

With reference to FIG. 5, a fourth alternative preferred embodiment 320 of a fire suppression system according to the present invention is illustrated. The fire suppression system 320 comprises a modular system that acts independently of the airplane water supply. A pressurized fluid source 352 provides pressure to force water from a water reservoir 354 through one or more of the fire suppression water lines 356 to a nozzle 358. The fire suppression to system 320 may include nozzles, sensors, and control units as described in the previous embodiments. In particular, a sensor 360 is included to sense heat or smoke from the waste container 16 which signals the cabin alert system 336 to indicate a fire is occurring. The nozzle 358 may include a eutectic valve as described in the first preferred embodiment 20. Therefore, when a fire occurs within the waste container 16, the eutectic substance would melt opening the nozzle 358 to allow water to be discharged from the reservoir 354. The pressure provided by the pressurized fluid source 352 automatically forces water through the fire suppression water lines 356 when the eutectic valve of the nozzle 358 is opened. A pressure gauge 360 provides a visual indication that a suitable pressure exists within the pressurized fluid source 352. A valve 362 allows easy refilling of the pressurized fluid source 352 when necessary. It is to be understood that the system 320 may also include sensors and solenoid valves to actuate the pressurized fluid source 352 as described in the previous embodiments. Furthermore, the water reservoir 354 may be formed of a clear material so that a flight attendant or technician may easily determine whether any water needs to be added to the water reservoir 354.

It is to be understood that any of the preferred embodiments described herein may be used with little or no modification to provide fire suppression to the entire fuselage of an aircraft. To this end, additional fire suppression water lines and nozzles may be installed throughout the aircraft to provide water to suitably positioned discharge nozzles which can spray water over a desired interior area of the aircraft. In this way, the presently disclosed invention may be expanded to suppress fires throughout an aircraft or may be installed simply to suppress fires with an area as small as a waste container in the lavatory. In particular, nozzles may be installed to create an optimal spray of water depending upon the application. Furthermore, the sensors of the present invention may detect particles from smoke or include infra-red sensors to detect a heat source such as a flame.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method for suppressing a fire with a fire suppression system adapted for use with a lavatory of an aircraft comprising:

providing a fluid supply;

communicating fluid from said fluid supply through at least one fluid communication line;

affixing at least one nozzle-to said fluid communication line;

providing a valve operatively associated with said nozzle and having a closed position and an open position, wherein when said valve assumes said open position when said fire is sensed to allow fluid to be evacuated from said fluid supply through said nozzle;

providing a primary supply and a secondary supply, wherein fluid from the primary supply is evacuated prior to fluid from the secondary supply being released therefrom; evacuating the secondary supply when an extended supply of the fluid is selected; and signaling a user that said fluid is being communicated through said at least one fluid communication line.

2. The method of claim 1, further comprising providing a pressurized fluid source for pressurizing said fluid to force said fluid through said communication line when said valve is opened.

3. The method of claim 2, further comprising placing a gauge-in communication with said pressurized fluid source to indicate a pressure within said pressurized fluid source.

4. The method of claim 1, wherein said valve comprises a eutectic valve operable to assume said open position in response to sensing a fire, thereby permitting said fluid to be discharged through said nozzle.

5. The method of claim 1, further comprising:

providing a controller; and providing at least one sensor adapted to sense the presence of a fire, wherein said sensor delivers a signal to said controller when the fire is detected.

6. The method of claim 5, wherein the valve comprises a solenoid valve positionable between said closed and said open positions by said controller.

7. The method of claim 1, further comprising utilizing an actuation sensor to indicate when said fluid is communicated through said fluid communication lines.

8. A fire suppression and alert system for suppressing a fire and alerting a user in an aircraft, comprising:

a fluid reservoir;

at least one nozzle, for producing a fire suppressing mist of fluid supplied from said fluid reservoir;

at least one fluid line connecting said fluid reservoir to said nozzle;

a valve, operatively coupled to said fluid line to control the communication of fluid through said fluid line from said fluid reservoir to said nozzle, said valve having a closed position and an open position;

a system to provide a signal to an individual to indicate that fluid has been evacuated through said nozzle via said fluid line;

a pressurized fluid source to provide pressure to said fluid reservoir to force fluid from said fluid reservoir through said fluid line; and a cabin alert system in the aircraft for informing the user that said valve is in said open position.

9. The fire suppression system of claim 8, wherein said fluid reservoir includes a primary reservoir and a secondary reservoir, and wherein fluid from said primary reservoir is evacuated prior to fluid from said secondary reservoir being released therefrom.

10. The fire suppression system of claim 8, further comprising a gauge in communication with said pressurized fluid source to indicate a pressure of said fluid contained within said pressurized fluid source.

11. The fire suppression system of claim 8, further comprising a sensor adapted to sense the presence of a fire and to generate a signal in response thereto.

12. The fire suppression system of claim 11, further comprising a controller responsive to said signal from said sensor; and wherein said valve comprises a solenoid valve, said controller being operable to control said operation of said valve between said open and closed positions in response to receipt of said signal from said sensor.

13. The method of claim 1, wherein evacuating the secondary supply occurs only after the first supply is substantially exhausted and the fire remains unsuppressed.

* * * * *